US011649963B2

(12) United States Patent
Hiromitsu et al.

(10) Patent No.: US 11,649,963 B2
(45) Date of Patent: May 16, 2023

(54) LIQUID FUEL INJECTOR

(71) Applicant: IHI CORPORATION, Tokyo (JP)

(72) Inventors: Nagayoshi Hiromitsu, Tokyo (JP); Kouta Kanai, Tokyo (JP)

(73) Assignee: IHI CORPORATION, Tokyo (JP)

( * ) Notice: Subject to any disclaimer, the term of this patent is extended or adjusted under 35 U.S.C. 154(b) by 89 days.

(21) Appl. No.: 17/065,962

(22) Filed: Oct. 8, 2020

(65) Prior Publication Data

US 2021/0025594 A1 Jan. 28, 2021

Related U.S. Application Data

(63) Continuation of application No. PCT/JP2019/013074, filed on Mar. 27, 2019.

(30) Foreign Application Priority Data

Jun. 1, 2018 (JP) ..... JP2018-106444

(51) Int. Cl.
*F23R 3/14* (2006.01)
*F23D 11/00* (2006.01)
(Continued)

(52) U.S. Cl.
CPC ..... *F23R 3/14* (2013.01); *F23D 11/00* (2013.01); *F23D 11/10* (2013.01); *F23D 11/38* (2013.01); *F23R 3/28* (2013.01); *F23R 3/30* (2013.01)

(58) Field of Classification Search
CPC ..... F23R 3/12; F23R 3/14; F23R 3/28; F23R 3/286; F23R 3/30
See application file for complete search history.

(56) References Cited

U.S. PATENT DOCUMENTS 3,915,387 A * 10/1975 Caruel ..... F23R 3/14 239/404
5,351,477 A * 10/1994 Joshi ..... F23D 17/002 60/737
(Continued)

FOREIGN PATENT DOCUMENTS

EP 2 224 171 A1 9/2010
JP 5-272711 A 10/1993
(Continued)

OTHER PUBLICATIONS

International Search Report dated Jun. 11, 2019 in PCT/JP2019/013074 filed Mar. 27, 2019, citing documents AA-AB and AO-AS therein, 2 pages.
(Continued)

*Primary Examiner* — Steven M Sutherland
(74) *Attorney, Agent, or Firm* — Oblon, McClelland, Maier & Neustadt, L.L.P.

(57) ABSTRACT

A liquid fuel injector includes a cylindrical center body including a center axis, an annular shroud concentrically disposed outside the center body, an annular fuel injection body disposed between and concentrically with the center body and the shroud, and including a fuel passage formed therein, a plurality of inner swirl vanes that are arranged in an equal cycle in an inner air passage between the center body and the fuel injection body, and are provided with an inner swirl vane action surface on an upstream side, a plurality of outer swirl vanes that are arranged in an equal cycle in an outer air passage between the fuel injection body and the shroud, and an outer swirl vane action surface on the upstream side.

1 Claim, 4 Drawing Sheets

(51) Int. Cl.

| | |
|---|---|
| ***F23D 11/10*** | (2006.01) |
| ***F23D 11/38*** | (2006.01) |
| ***F23R 3/28*** | (2006.01) |
| ***F23R 3/30*** | (2006.01) |

(56) References Cited

U.S. PATENT DOCUMENTS

| | | | | |
|---|---|---|---|---|
| 6,141,967 | A | 11/2000 | Angel et al. | |
| 8,910,480 | B2 | 12/2014 | Suria et al. | |
| 9,429,074 | B2 | 8/2016 | Williams et al. | |
| 10,451,282 | B2 | 10/2019 | Benjamin et al. | |
| 2001/0023590 | A1 | 9/2001 | Mandai et al. | |
| 2003/0014975 | A1 | 1/2003 | Nishida et al. | |
| 2005/0039456 | A1* | 2/2005 | Hayashi | F23R 3/32 60/737 |
| 2006/0236700 | A1 | 10/2006 | Saitoh et al. | |
| 2007/0289305 | A1* | 12/2007 | Oda | F23R 3/286 60/748 |
| 2007/0289306 | A1* | 12/2007 | Suria | F23R 3/14 60/748 |
| 2008/0148736 | A1* | 6/2008 | Ishizaka | F23R 3/286 60/737 |
| 2010/0011772 | A1* | 1/2010 | Gashi | F23R 3/343 60/748 |
| 2014/0033722 | A1 | 2/2014 | Abdel-Hafez et al. | |
| 2014/0123661 | A1* | 5/2014 | Biagioli | F23R 3/14 60/737 |
| 2014/0202161 | A1 | 7/2014 | Yuasa et al. | |
| 2016/0010856 | A1 | 1/2016 | Biagioli et al. | |
| 2016/0177834 | A1 | 6/2016 | Patel et al. | |
| 2016/0265780 | A1 | 9/2016 | Patel et al. | |
| 2016/0363320 | A1 | 12/2016 | Benjamin et al. | |
| 2017/0159937 | A1 | 6/2017 | Kobayashi et al. | |
| 2018/0298824 | A1 | 10/2018 | Matsuyama et al. | |
| 2018/0372319 | A1 | 12/2018 | Matsuyama et al. | |

FOREIGN PATENT DOCUMENTS

| | | | |
|---|---|---|---|
| JP | 10-185196 | A | 7/1998 |
| JP | 11-83016 | A | 3/1999 |
| JP | 2002-61839 | A | 2/2002 |
| JP | 2003-14232 | A | 1/2003 |
| JP | 2005-106411 | A | 4/2005 |
| JP | 2006-300448 | A | 11/2006 |
| JP | 2006-336997 | A | 12/2006 |
| JP | 2010-181108 | A | 8/2010 |
| JP | 2012-37209 | A | 2/2012 |
| JP | 2014-159942 | A | 9/2014 |
| JP | 2016-17739 | A | 2/2016 |
| JP | 2016-41920 | A | 3/2016 |
| JP | 2016-118380 | A | 6/2016 |
| JP | 2016-173225 | A | 9/2016 |
| JP | 2017-3257 | A | 1/2017 |
| JP | 2017-502243 | A | 1/2017 |
| JP | 2017-116139 | A | 6/2017 |
| JP | 2017-116158 | A | 6/2017 |

OTHER PUBLICATIONS

Extended European Search Report dated Feb. 9, 2022 in European Patent Application No. 19812430.7, citing documents AA, AB and AO therein, 6 pages.

* cited by examiner

LIQUID FUEL INJECTOR

TECHNICAL FIELD

The present disclosure relates to a liquid fuel injector, and in particular to an air-blast type liquid fuel injector that atomizes liquid fuel injected as an annular liquid film by use of shearing force acting between the liquid fuel and swirling airflow flowing adjacent to an inner side and an outer side in a radial direction of the injector.

BACKGROUND ART

It is desirable that in a case of combusting liquid fuel in a combustor of a gas turbine, the liquid fuel is atomized to promote vaporization of the liquid fuel and mixing with combustion air. The atomization of the liquid fuel also contributes to reduction in emission of NOx (nitrogen oxides) as well as unburned fuel and CO (carbon monoxide) through speedup of combustion reaction.

An example of an atomization method of the liquid fuel is an air-blast method. This is a method of atomizing liquid fuel injected as a film by use of shearing force caused by a difference in velocity from airflow flowing adjacent to this fuel.

An example of a liquid fuel injector in which the air-blast method is employed is disclosed in Patent Document 1 (FIG. 4). This liquid fuel injector is formed to atomize liquid fuel injected as an annular liquid film from an annular nozzle (40) by use of shearing force acting between the liquid fuel and airflow flowing adjacent to an inner side and an outer side in a radial direction of the injector. For purposes of increasing a difference in velocity between flow of the film-like liquid fuel and the airflow to promote the atomization of the liquid fuel and further of uniformly dispersing the atomized liquid fuel in a circumferential direction, the airflow is swirled by a swirler (31, 32) disposed in an annular air passage. As this swirler, a helical vane is conventionally used as described later.

FIG. 4 is a schematic cross-sectional view showing a main part of a conventional air-blast type liquid fuel injector in which the helical vane is employed as the swirler. Note that the drawing only shows a cross section of one side (upside) with respect to a center axis C.

A liquid fuel injector 1 is provided with a cylindrical center body 10 including the center axis C, an annular shroud 30 concentrically disposed outside the center body 10 in a radial direction, and a hollow double cylindrical fuel injection body 20 disposed between and concentrically with the center body 10 and the shroud 30 and including an annular liquid fuel passage Pf formed therein.

An annular inner air passage Pai and an outer air passage Pao are formed between the center body 10 and the fuel injection body 20 and between the fuel injection body 20 and the shroud 30, respectively. Then, a plurality of inner swirl vanes 15 and outer swirl vanes 25 are arranged at an equal interval in a circumferential direction in the inner air passage Pai and the outer air passage Pao, respectively.

Consequently, airflow flowing into the inner air passage Pai and the outer air passage Pao as shown by arrows Fai and Fao in FIG. 4, respectively, is swirled during passing through the inner swirl vane 15 and the outer swirl vane 25, and flows outward into a combustion chamber CC as swirling flow including a circumferential velocity component. At this time, shearing force caused by a difference in velocity from the airflow including the circumferential velocity component and flowing outward from each of the inner air passage Pai and the outer air passage Pao acts on liquid fuel injected as a film from the annular liquid fuel passage Pf formed in the fuel injection body 20 as shown by an arrow Ff in FIG. 4, and consequently, the liquid fuel is atomized.

RELATED ART DOCUMENT

Patent Document

Patent Document 1: Japanese Patent Laid-Open No. H10-185196

SUMMARY OF THE DISCLOSURE

Problems to be Solved by the Disclosure

Now, in a conventional air-blast type liquid fuel injector 1 described above, each of an inner swirl vane 15 and an outer swirl vane 25 is formed as a helical vane. This helical vane is formed so that each of cross sections 15S and 25S in a plane including a center axis C (a paper surface of FIG. 4) extends in a direction substantially perpendicular to the center axis C (a radial direction).

In a case where airflow passes through an inner air passage Pai and an outer air passage Pao in which the inner swirl vane 15 and the outer swirl vane 25 formed as such helical vanes are arranged, respectively, velocity distributions (radial distributions of axial velocity components) at outlets of the respective air passages are denoted with Vi and Vo, respectively. Each of these distributions is a distribution having a peak shifted to an outer side in the radial direction, as compared with velocity distributions Vi0 and Vo0 that are symmetrical in the radial direction in a case where any helical vanes (swirl vanes) are not present. This is because the airflow is biased to an outer side in the radial direction in each air passage under an influence of centrifugal force acting due to the airflow being swirled during passing through the helical vane (the swirl vane).

In these distributions, the peak of the velocity distribution Vi is close to flow Ff of the film-like liquid fuel injected from a fuel injection body 20, and hence a degree of contribution to atomization of the liquid fuel is large, while the peak of the velocity distribution Vo is noticeably away from the flow Ff of the film-like liquid fuel injected from the fuel injection body 20, and hence the degree of contribution to the atomization of the liquid fuel is small.

Thus, the air-blast type liquid fuel injector in which the helical vane having such a shape as described above is employed as a swirler does not necessarily have a large degree of contribution to the atomization of the liquid fuel. Therefore, a large flow rate of air is required to achieve desired atomization of the liquid fuel, and accordingly, pressure loss generated in the helical vane increases. Considering from a reverse perspective, a level of the atomization of the liquid fuel that is achieved with the same air flow rate (or pressure loss) drops.

The present disclosure has been developed in view of such problems as described above, and an object of the present disclosure is to provide an air-blast type liquid fuel injector that is capable of achieving required atomization of liquid fuel at a smaller air flow rate (or smaller pressure loss).

Means for Solving the Problems

In order to achieve the above object, an aspect of the present disclosure is directed to a liquid fuel injector provided with a cylindrical center body including a center axis, an annular shroud concentrically disposed outside the center body in a radial direction, an annular fuel injection body disposed between and concentrically with the center body and the shroud, and including a liquid fuel passage formed therein, a plurality of inner swirl vanes that are arranged in an equal cycle in a circumferential direction in an annular inner air passage formed between the center body and the fuel injection body, and are provided with an inner swirl vane action surface on an upstream side in an airflow direction in the inner air passage, and a plurality of outer swirl vanes that are arranged in an equal cycle in the circumferential direction in an annular outer air passage formed between the fuel injection body and the shroud, and are provided with an outer swirl vane action surface on an upstream side in an airflow direction in the outer air passage, wherein at least one and a part of the one of an inner swirl vane action surface profile that is an intersection line between the inner swirl vane action surface and a plane including the center axis, and an outer swirl vane action surface profile that is an intersection line between the outer swirl vane action surface and the plane including the center axis are inclined with respect to a direction perpendicular to the center axis.

Effects of the Disclosure

According to the present disclosure, a liquid fuel injector can be effective in that liquid fuel atomization of a high level can be achieved under the same air flow rate (or pressure loss) and in that an air flow rate (or pressure loss) required to achieve liquid fuel atomization of the same level can be minimized.

MODE FOR CARRYING OUT THE DISCLOSURE

Hereinafter, description will be made as to embodiments of the present disclosure in detail with reference to the drawings.

Figure 1:
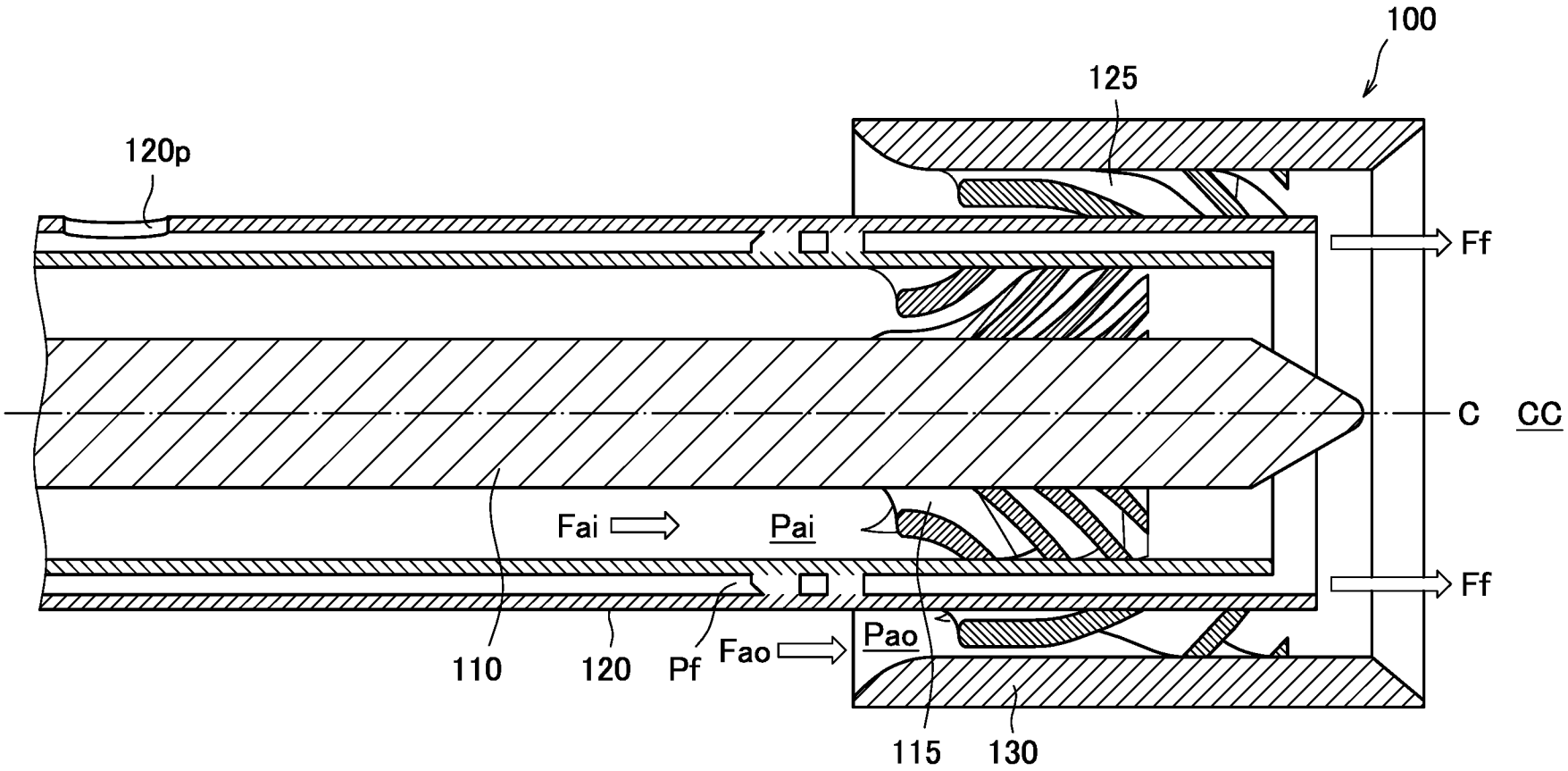
FIG. 1 is a schematic cross-sectional view of an entire air-blast type liquid fuel injector according to a first embodiment of the present disclosure.

FIG. 1 is a schematic cross-sectional view of an entire air-blast type liquid fuel injector according to a first embodiment of the present disclosure. Note that in the present description, an upstream side and a downstream side in air and liquid fuel flow directions described later will be referred to as a front side and a rear side, respectively.

A liquid fuel injector 100 is provided with a cylindrical center body 110 having a center axis C, an annular shroud 130 concentrically disposed outside the center body 110 in a radial direction, and an annular fuel injection body 120 disposed between and concentrically with the center body 110 and the shroud 130.

The fuel injection body 120 includes an outer wall and an inner wall that are annular, and includes an annular liquid fuel passage Pf formed between these two walls. Furthermore, a liquid fuel inflow port 120*p* is formed in a front end portion of the annular outer wall of the fuel injection body 120.

An inner air passage Pai and an outer air passage Pao that are annular are formed between the center body 110 and the fuel injection body 120 and between the fuel injection body 120 and the shroud 130, respectively. Then, a plurality of inner swirl vanes 115 and outer swirl vanes 125 are arranged in an equal cycle in a circumferential direction in the inner air passage Pai and the outer air passage Pao, respectively.

Air flows into each of the inner air passage Pai and the outer air passage Pao as shown by each of arrows Fai and Fao in FIG. 1, and is swirled during passing through each of the inner swirl vane 115 and the outer swirl vane 125, and the air flows outward into a combustion chamber CC as swirling flow including a circumferential velocity component.

The liquid fuel flows into the annular liquid fuel passage Pf through the liquid fuel inflow port 120*p* formed in the front end portion of the outer wall of the fuel injection body 120, and is injected from a rear end portion of the fuel injection body 120 into the combustion chamber CC as shown by an arrow Ff in FIG. 1, to form an annular liquid film. At this time, shearing force acts on the injected liquid fuel, the shearing force being caused by a difference in velocity from airflow including the circumferential velocity component as described above and flowing outward from each of the inner air passage Pai and the outer air passage Pao, and consequently, the liquid fuel is atomized.

Also in the air-blast type liquid fuel injector 100 of the present disclosure, each of the inner swirl vane 115 and the outer swirl vane 125 is formed as a helical vane, and this helical vane is formed so that each of cross sections 115S and 125S (see FIG. 2) in a plane including the center axis C (each of paper surfaces of FIG. 1 and FIG. 2) is inclined with respect to a direction substantially perpendicular to the center axis C (the radial direction). This respect will be described in detail as follows.

Figure 2:
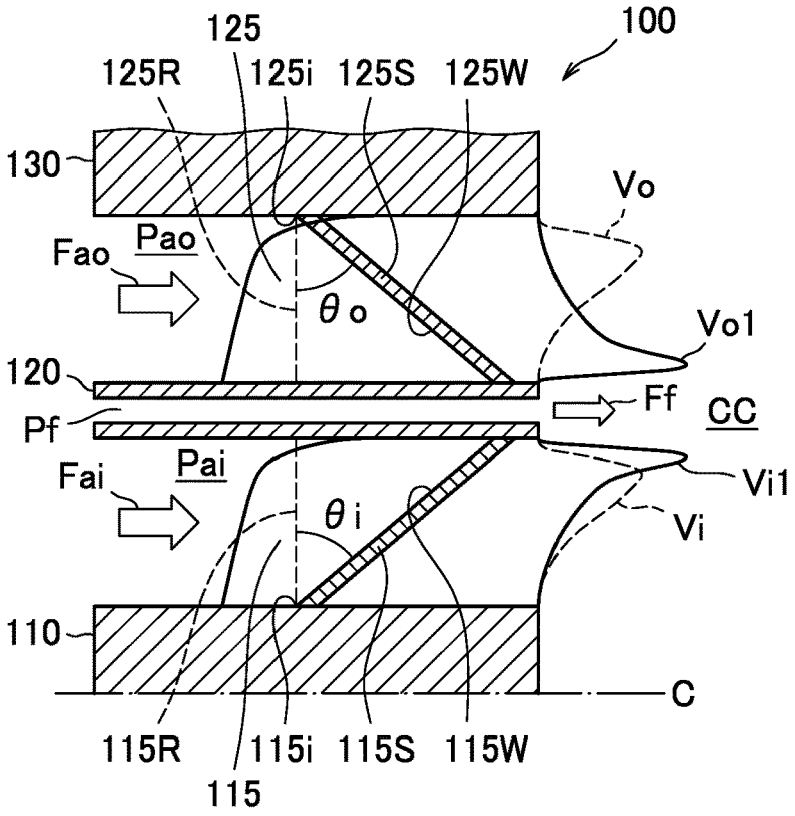
FIG. 2 is a schematic cross-sectional view showing a main part of the air-blast type liquid fuel injector of FIG. 1.

FIG. 2 is a schematic cross-sectional view showing a main part of the liquid fuel injector 100. Note that the drawing only shows a cross section of one side (upside) with respect to the center axis C.

As shown in FIG. 2, the inner swirl vane 115 disposed in the inner air passage Pai has the cross section 115S in the plane (the paper surface of FIG. 2) including the center axis C, the cross section being inclined outward in the radial direction toward the rear side (the downstream side) (in other words, at least a part of an optional portion of the cross section 115S is located on an outer side in the radial direction as compared with a portion located in front of (on the upstream side of) the above optional portion).

In this illustrated example, the inner swirl vane 115 is formed so that an intersection line (hereinafter, referred to as an inner swirl vane action surface profile) 115W between a surface located on the upstream side, i.e., an inner swirl vane action surface having a function of swirling the airflow and the plane (the paper surface of FIG. 2) including the center axis C becomes a straight line or a curved line inclined (having an angle) outward in the radial direction toward the rear side (the downstream side).

Then, a predetermined angle that is not 0°, i.e., an inner swirl vane inclination angle θi is formed between a straight line 115R extending in the radial direction through a start point 115*i* that is a front end (an upstream end) of the inner swirl vane action surface profile 115W and at least a part of the inner swirl vane action surface profile 115W.

The inner swirl vane inclination angle θi is an angle less than 90° that takes a positive or negative sign in a case where an angle from the straight line 115R to the inner swirl vane action surface profile 115W is measured clockwise or counterclockwise, and it is preferable that an absolute value |θi| of the angle is 45° or more (|θi|≥45°). In the illustrated example, the sign of θi is positive, i.e., θi>0°, and hence preferably θi≥45°.

Similarly, the outer swirl vane 125 disposed in the outer air passage Pao has the cross section 125S in the plane (the paper surface of FIG. 2) including the center axis C, the cross section being inclined inward in the radial direction toward the rear side (the downstream side) (in other words, at least a part of an optional portion of the cross section 125S is located on an inner side in the radial direction as compared with a portion located in front of (on the upstream side of) the above optional portion).

In this illustrated example, the outer swirl vane 125 is formed so that an intersection line (hereinafter, referred to as an outer swirl vane action surface profile) 125W between a surface located on the upstream side, i.e., an outer swirl vane action surface having a function of swirling the airflow and the plane (the paper surface of FIG. 2) including the center axis C becomes a straight line or a curved line inclined (having an angle) inward in the radial direction toward the rear side (the downstream side).

Then, a predetermined angle that is not 0°, i.e., an outer swirl vane inclination angle θo is formed between a straight line 125R extending in the radial direction through a start point 125*i* that is a front end (an upstream end) of the outer swirl vane action surface profile 125W and at least a part of the outer swirl vane action surface profile 125W.

The outer swirl vane inclination angle θo, similarly to the inner swirl vane inclination angle θi, is also an angle less than 90° that takes a positive or negative sign in a case where an angle from the straight line 125R to the outer swirl vane action surface profile 125W is measured clockwise or counterclockwise, and it is preferable that an absolute value |θo| of the angle is 45° or more (|θo|≥45°). In the illustrated example, the sign of θo is negative, i.e., θo<0°, and hence preferably θo≤−45°.

Note that in the above, description has been made on assumption that each of the inner swirl vane action surface profile 115W and the outer swirl vane action surface profile 125W is the straight line. However, in a case where these profiles are curved lines, angles between tangent lines of the curved lines in inclined parts and the straight lines 115R, 125R are the inner swirl vane inclination angle θi and the outer swirl vane inclination angle θo, respectively.

In a case where, as shown by the arrows Fai and Fao, the airflow passes through the inner air passage Pai and the outer air passage Pao in which the inner swirl vane 115 and the outer swirl vane 125 having configurations described above are arranged, respectively, velocity distributions (radial distributions of axial velocity components) at outlets of the respective air passages are denoted with Vi1 and Vo1, respectively.

Figure 4:
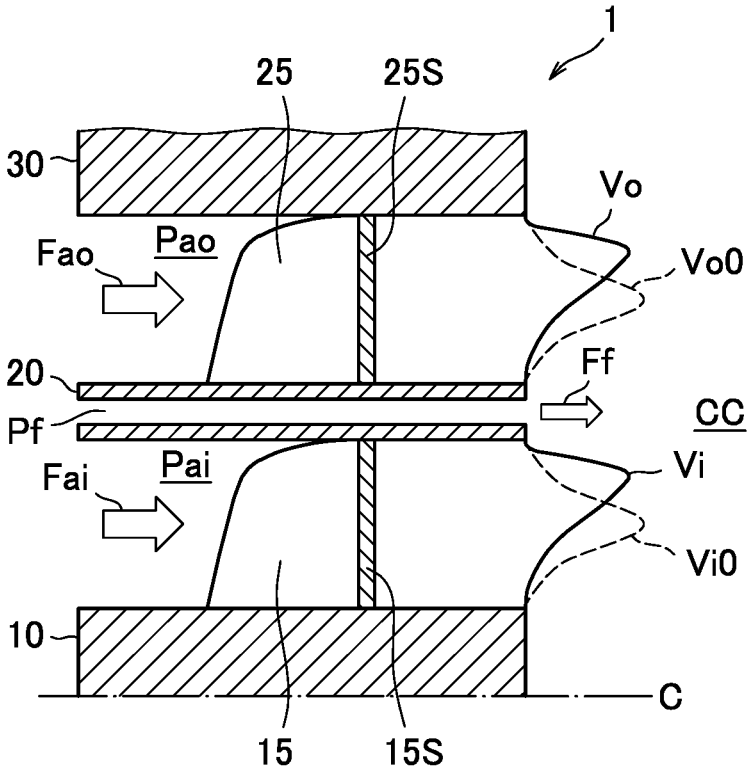
FIG. 4 is a schematic cross-sectional view showing a main part of a conventional air-blast type liquid fuel injector.

In these distributions, the velocity distribution Vi1 at the outlet of the inner air passage Pai is a distribution having a peak shifted to an outer side in the radial direction as compared with a velocity distribution Vi in a conventional liquid fuel injector 1 (see FIG. 4). This peak is shifted because the inner swirl vane action surface profile 115W of the inner swirl vane 115 disposed in the inner air passage Pai is inclined outward in the radial direction toward the rear side (the downstream side).

The velocity distribution Vo1 at the outlet of the outer air passage Pao is a distribution having a peak shifted to an inner side in the radial direction as compared with a velocity distribution Vo in the conventional liquid fuel injector 1 (see FIG. 4). This peak is shifted because the outer swirl vane action surface profile 125W of the outer swirl vane 125 disposed in the outer air passage Pao is inclined inward in the radial direction toward the rear side (the downstream side).

The peak in each of these velocity distributions Vi1 and Vo1 is located remarkably close to the flow of the film-like liquid fuel injected from the fuel injection body 120, and hence a degree of contribution to atomization of the liquid fuel noticeably increases. Therefore, according to the liquid fuel injector 100 of the present disclosure, liquid fuel atomization of a high level can be achieved under the same air flow rate (or pressure loss), and an air flow rate (or pressure loss) required to achieve liquid fuel atomization of the same level can be minimized.

In the above, the embodiment has been described in which for a purpose of maximizing a performance of atomizing the liquid fuel, the inner swirl vane action surface profile 115W is inclined outward in the radial direction toward the rear side (the downstream side), and the outer swirl vane action surface profile 125W is inclined inward in the radial direction toward the rear side (the downstream side). However, effects different from those described above can be obtained by inclining the inner swirl vane and the outer swirl vane in another aspect.

Figure 3A:
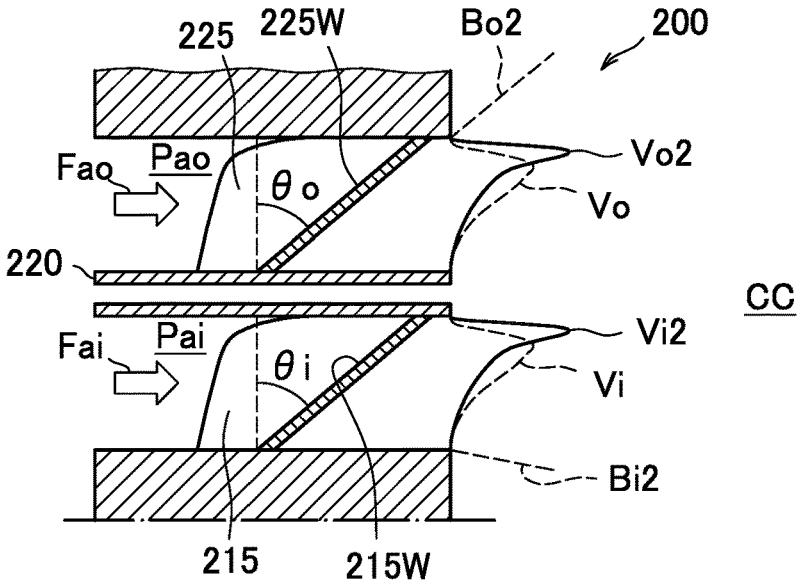
FIG. 3A is a schematic cross-sectional view showing a main part of an air-blast type liquid fuel injector according to a second embodiment of the present disclosure.
Figure 3B:
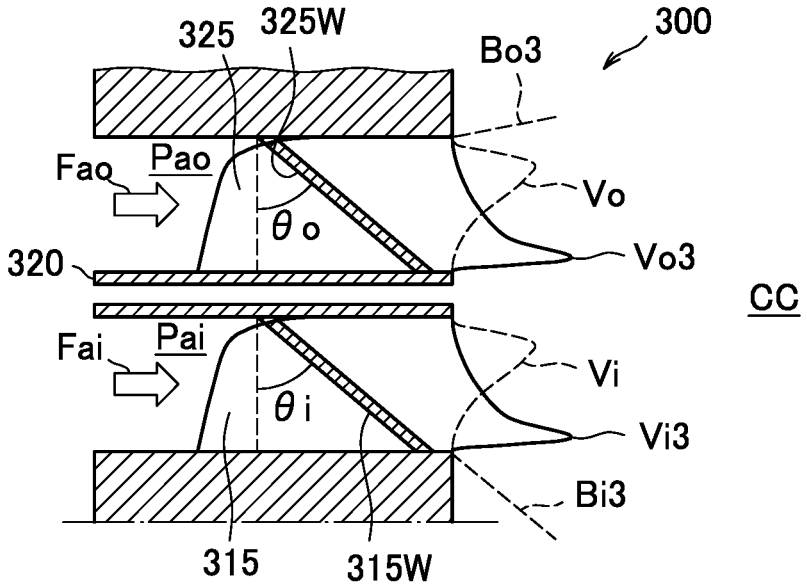
FIG. 3B is a schematic cross-sectional view showing a main part of an air-blast type liquid fuel injector according to a third embodiment of the present disclosure.
Figure 3C:
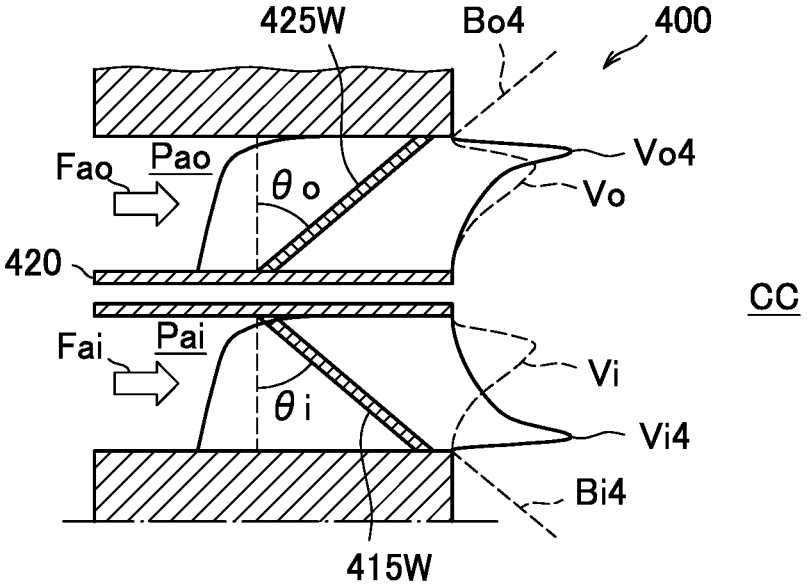
FIG. 3C is a schematic cross-sectional view showing a main part of an air-blast type liquid fuel injector according to a fourth embodiment of the present disclosure.

FIG. 3A to FIG. 3C are schematic cross-sectional views showing main parts of air-blast type liquid fuel injectors of further embodiments of the present disclosure.

In a liquid fuel injector 200 of a second embodiment of the present disclosure shown in FIG. 3A, an inner swirl vane action surface profile 215W is inclined outward in a radial direction toward a rear side (a downstream side) in the same manner as in the liquid fuel injector 100 of the first embodiment, while an outer swirl vane action surface profile 225W is inclined outward in the radial direction toward the rear side (the downstream side) conversely to the liquid fuel injector 100 of the first embodiment. In this case, signs of an inner swirl vane inclination angle θi and an outer swirl vane inclination angle θo are both positive, i.e., θi>0° and θo>0°, and hence preferably θi≥45° and θo≥45°.

In a case where, as shown by arrows Fai and Fao, the airflow passes through an inner air passage Pai and an outer air passage Pao in which an inner swirl vane 215 and an outer swirl vane 225 having configurations described above are arranged, respectively, velocity distributions (radial distributions of axial velocity components) at outlets of the respective air passages are denoted with Vi2 and Vo2, respectively.

In these distributions, the velocity distribution Vi2 at the outlet of the inner air passage Pai is similar to the velocity distribution Vi1 in the liquid fuel injector 100 of the first embodiment, but the velocity distribution Vo2 at the outlet of the outer air passage Pao is a distribution having a peak shifted to an outer side in the radial direction as compared with the velocity distribution Vo in the conventional liquid fuel injector 1 (see FIG. 4).

These velocity distributions Vi2 and Vo2 are combined, to improve a level of atomization of liquid fuel, by use of a peak of the velocity distribution Vi2 that is located remarkably close to flow of the film-like liquid fuel injected from a fuel injection body 220. At the same time, a mixture of air and liquid fuel injected from the liquid fuel injector 200 can be dispersed broadly to a region that is away from a center axis C to an outer side in the radial direction in a combustion chamber CC, by use of a peak of the velocity distribution Vo2 that is located close to an outer end of the outer air passage Pao in the radial direction (in FIG. 3A, an outer edge Bo2 and an inner edge Bit of flow of the mixture of air and liquid fuel injected from the liquid fuel injector 200 are shown with broken lines, to see the outer edge Bo2 of these edges).

By use of such a configuration, a combustion region in the combustion chamber CC can be appropriately adjusted in accordance with a purpose.

For example, in a case where an injected mixture of air and liquid fuel is required to be dispersed broadly to a region in a vicinity of a center axis C in a combustion chamber CC while improving a level of atomization of the liquid fuel, as in a liquid fuel injector 300 of a third embodiment of the present disclosure shown in FIG. 3B, an outer swirl vane action surface profile 325W may be inclined inward in a radial direction toward a rear side (a downstream side) in the same manner as in the liquid fuel injector 100 of the first embodiment, while an inner swirl vane action surface profile 315W may be inclined inward in the radial direction toward the rear side (the downstream side) conversely to the liquid fuel injector 100 of the first embodiment. In this case, signs of an inner swirl vane inclination angle θi and an outer swirl vane inclination angle θo are both negative, i.e., $\theta i<0°$ and $\theta o<0°$, and hence preferably $\theta i\leq-45°$ and $\theta o\leq-45°$.

In a case where, as shown by arrows Fai and Fao, airflow passes through an inner air passage Pai and an outer air passage Pao in which an inner swirl vane 315 and an outer swirl vane 325 having configurations described above are arranged, respectively, velocity distributions (radial distributions of axial velocity components) at outlets of the respective air passages are denoted with Vi3 and Vo3, respectively.

In these distributions, the velocity distribution Vo3 at the outlet of the outer air passage Pao is similar to the velocity distribution Vo1 in the liquid fuel injector 100 of the first embodiment, but the velocity distribution Vi3 at the outlet of the inner air passage Pai is a distribution having a peak shifted to an inner side in the radial direction as compared with the velocity distribution Vi in the conventional liquid fuel injector 1 (see FIG. 4).

These velocity distributions Vi3 and Vo3 are combined, to improve a level of atomization of liquid fuel, by use of a peak of the velocity distribution Vo3 that is located remarkably close to flow of the film-like liquid fuel injected from a fuel injection body 320. At the same time, a mixture of air and liquid fuel injected from the liquid fuel injector 300 can be concentrated in a vicinity of a center axis C in a combustion chamber CC, by use of a peak of the velocity distribution Vi3 that is located close to an inner end of the inner air passage Pai in the radial direction (in FIG. 3B, an outer edge Bo3 and an inner edge Bi3 of flow of the mixture of air and liquid fuel injected from the liquid fuel injector 300 are shown with broken lines, to see the inner edge Bi3 of these edges).

Note that in a case where dispersing an injected mixture of air and liquid fuel broadly to both a region in a vicinity of a center axis C and a region away to an outer side in a radial direction in a combustion chamber CC is required rather than improving a level of atomization of the liquid fuel, as in a liquid fuel injector 400 of a fourth embodiment of the present disclosure shown in FIG. 3C, an inner swirl vane action surface profile 415W may be inclined inward in the radial direction toward a rear side (a downstream side), and an outer swirl vane action surface profile 425W may be inclined outward in the radial direction toward the rear side (the downstream side). In this case, a sign of an inner swirl vane inclination angle θi is negative, i.e., $\theta i<0°$, and a sign of an outer swirl vane inclination angle θo is positive, i.e., $\theta o>0°$, and hence preferably $\theta i\leq-45°$ and $\theta o\geq45°$.

Consequently, flow of the mixture of air and liquid fuel injected from the liquid fuel injector 400 can be dispersed broadly to both a region in a vicinity of the center axis C and a region away to an outer side in the radial direction in the combustion chamber CC, as shown by an outer edge Bo4 and an inner edge Bi4 of the injector.

Note that in the above, description has been made as to a case where each of the inner swirl vane and the outer swirl vane is formed as the helical vane so that the cross section in the plane including the center axis is inclined with respect to the direction substantially perpendicular to the center axis (the radial direction), but the liquid fuel injector of the present disclosure is not limited to this case. That is, in the liquid fuel injector of the present disclosure, only one swirl vane of the inner swirl vane and the outer swirl vane may be the helical vane of the above described aspect, and the other swirl vane may be another helical vane (i.e., the vane formed so that the cross section in the plane including the center axis extends in the direction substantially perpendicular to the center axis C (the radial direction)). In other words, in the liquid fuel injector of the present disclosure, at least one of the inner swirl vane and the outer swirl vane is formed as the helical vane of the above described aspect.

As described above, the liquid fuel injector of the present disclosure can be adapted to one of purposes of improving the level of the liquid fuel atomization and of dispersing the injected mixture of air and liquid fuel, by changing the velocity distribution in the air passage in which the swirl vane is disposed (the radial distribution of the axial velocity component) through adjustment of a cross-sectional shape of the swirl vane in the plane including the center axis.

(Aspects of the Present Disclosure)

A liquid fuel injector of a first aspect of the present disclosure is provided with a cylindrical center body including a center axis, an annular shroud concentrically disposed outside the center body in a radial direction, an annular fuel injection body disposed between and concentrically with the center body and the shroud, and including a liquid fuel passage formed therein, a plurality of inner swirl vanes that are arranged in an equal cycle in a circumferential direction in an annular inner air passage formed between the center body and the fuel injection body, and are provided with an inner swirl vane action surface on an upstream side in an airflow direction in the inner air passage, and a plurality of outer swirl vanes that are arranged in an equal cycle in the circumferential direction in an annular outer air passage formed between the fuel injection body and the shroud, and are provided with an outer swirl vane action surface on an upstream side in an airflow direction in the outer air passage, wherein at least one and a part of the one of an inner swirl vane action surface profile that is an intersection line between the inner swirl vane action surface and a plane including the center axis, and an outer swirl vane action surface profile that is an intersection line between the outer swirl vane action surface and the plane including the center axis are inclined with respect to a direction perpendicular to the center axis.

In the liquid fuel injector of a second aspect of the present disclosure, in a case where each of the inner swirl vane action surface profile and the outer swirl vane action surface profile is a straight line, an angle from a straight line extending in the direction perpendicular to the center axis through an upstream end of the inner swirl vane action surface profile to the inner swirl vane action surface profile is referred to as an inner swirl vane inclination angle, an angle from a straight line extending in the direction perpendicular to the center axis through an upstream end of the outer swirl vane action surface profile to the outer swirl vane action surface profile is referred to as an outer swirl vane inclination angle, and each of these inclination angles is defined as an angle less than 90° that takes a positive or negative sign when measured clockwise or counterclockwise, at least one of an absolute value of the inner swirl vane inclination angle and an absolute value of the outer swirl vane inclination angle is larger than 0°.

In the liquid fuel injector of a third aspect of the present disclosure, in a case where each of the inner swirl vane action surface profile and the outer swirl vane action surface profile is a curved line, an angle from a straight line extending in the direction perpendicular to the center axis through an upstream end of the inner swirl vane action surface profile to a tangent line in an inclined part of the inner swirl vane action surface profile is referred to as an inner swirl vane inclination angle, an angle from a straight line extending in the direction perpendicular to the center axis through an upstream end of the outer swirl vane action surface profile to a tangent line in an inclined part of the outer swirl vane action surface profile is referred to as an outer swirl vane inclination angle, and each of these inclination angles is defined as an angle less than 90° that takes a positive or negative sign when measured clockwise or counterclockwise, at least one of an absolute value of the inner swirl vane inclination angle and an absolute value of the outer swirl vane inclination angle is larger than 0°.

In the liquid fuel injector of a fourth aspect of the present disclosure, the inner swirl vane inclination angle is larger than 0°, and the outer swirl vane inclination angle is smaller than 0°.

In the liquid fuel injector of a fifth aspect of the present disclosure, the inner swirl vane inclination angle is 45° or more, and the outer swirl vane inclination angle is −45° or less.

In the liquid fuel injector of a sixth aspect of the present disclosure, the inner swirl vane inclination angle is larger than 0°, and the outer swirl vane inclination angle is larger than 0°.

In the liquid fuel injector of a seventh aspect of the present disclosure, the inner swirl vane inclination angle is 45° or more, and the outer swirl vane inclination angle is 45° or more.

In the liquid fuel injector of an eighth aspect of the present disclosure, the inner swirl vane inclination angle is smaller than 0°, and the outer swirl vane inclination angle is smaller than 0°.

In the liquid fuel injector of a ninth aspect of the present disclosure, the inner swirl vane inclination angle is −45° or less, and the outer swirl vane inclination angle is −45° or less.

In the liquid fuel injector of a tenth aspect of the present disclosure, the inner swirl vane inclination angle is smaller than 0°, and the outer swirl vane inclination angle is larger than 0°.

In the liquid fuel injector of an eleventh aspect of the present disclosure, the inner swirl vane inclination angle is −45° or less, and the outer swirl vane inclination angle is 45° or more.

EXPLANATION OF REFERENCE SIGNS

100 liquid fuel injector
110 center body
115 inner swirl vane
115W inner swirl vane action surface profile
120 fuel injection body
125 outer swirl cane
125W outer swirl vane action surface profile
130 shroud
C center axis
Pai inner air passage
Pao outer air passage
Pf liquid fuel passage
θi inner swirl vane inclination angle
θo outer swirl vane inclination angle

The invention claimed is:

1. A liquid fuel injector comprising:

a cylindrical center body including a center axis, an annular shroud concentrically disposed outside the cylindrical center body in a radial direction, an annular fuel injection body disposed between and concentrically with the cylindrical center body and the annular shroud, and including a liquid fuel passage formed therein, a plurality of inner swirl vanes that are arranged in an equal cycle in a circumferential direction in an annular inner air passage formed between the cylindrical center body and the annular fuel injection body, and comprise an inner swirl vane action surface on an upstream side in an airflow direction in the inner annular air passage, and a plurality of outer swirl vanes that are arranged in an equal cycle in the circumferential direction in an annular outer air passage formed between the annular fuel injection body and the annular shroud, and comprise an outer swirl vane action surface on an upstream side in an airflow direction in the annular outer air passage, wherein at least one and a part of the one of an inner swirl vane action surface profile that is an intersection line between the inner swirl vane action surface and a plane including the center axis and the radial direction, and an outer swirl vane action surface profile that is an intersection line between the outer swirl vane action surface and the plane including the center axis and the radial direction are inclined with respect to the radial direction, and in a case where each of the inner swirl vane action surface profile and the outer swirl vane action surface profile is a straight line or a curved line, an angle from a straight line extending in the radial direction through an upstream end of the inner swirl vane action surface profile, to the inner swirl vane action surface profile or a tangent line in an inclined part of the inner swirl vane action surface profile is an inner swirl vane inclination angle, an angle from a straight line extending in the radial direction through an upstream end of the outer swirl vane action surface profile, to the outer swirl vane action surface profile or a tangent line in an inclined part of the outer swirl vane action surface profile is an outer swirl vane inclination angle, each of the inner swirl vane and outer swirler vane inclination angles is defined as an angle less than 90° that takes a positive or negative sign when measured clockwise or counterclockwise, and the inner swirl vane inclination angle and the outer swirl vane inclination angle are both positive, or different in the sign from each other and an absolute value of the inner swirl vane inclination angle and an absolute value of the outer swirl vane inclination angle are both 45° or more.

* * * * *